US005376053A

United States Patent [19]

Ponder et al.

[11] Patent Number: 5,376,053

[45] Date of Patent: Dec. 27, 1994

[54] REMOTELY OPERATED MOTORIZED SWING

[76] Inventor: Patricia D. Ponder, Gaylon D. Ponder, both of P.O. Box 125, Bremen, Ala. 35033-0125

[21] Appl. No.: 100,376

[22] Filed: Aug. 2, 1993

[51] Int. Cl.[5] ..... A63G 9/16

[52] U.S. Cl. ..... 472/119; 472/32; D21/246

[58] Field of Search ..... 472/119, 118, 29, 32; 297/260, 344.1, 330, 256.12; 5/108, 109; D21/246

[56] References Cited

U.S. PATENT DOCUMENTS

| | | | |
|---|---|---|---|
| 1,842,290 | 1/1932 | Salamon | 5/109 |
| 3,825,962 | 7/1974 | Grounds et al. | 297/256.12 |
| 4,150,820 | 4/1979 | Bochmann | 472/119 |
| 4,448,410 | 5/1984 | Kosoff | 472/119 |
| 4,491,317 | 1/1985 | Bansal | 472/119 |
| 4,616,824 | 10/1986 | Quilan, Jr. et al. | 472/119 |
| 4,911,492 | 3/1990 | Ogbu | 472/119 |

*Primary Examiner*—Carl D. Friedman
*Assistant Examiner*—Kien Nguyen
*Attorney, Agent, or Firm*—Veal & Associates

[57] ABSTRACT

A motorized swing for disabled persons and children which provides pendulous reciprocal movement as well as rotational movement. Electric motors drive mechanisms for inducing reciprocal and rotational movement either separately or in combination. Sensory activated switches are electrically connected to said motors to allow handicapped persons and children to control the movement of said swing.

16 Claims, 3 Drawing Sheets

17
21a
32
19b
32a
29a
33a
32b
15
29
27
26
28
31
12
12
25
33
18b
18a
22
34
23
46
24
22
23
33b
42
38
36a
48
36
37
36b
35
39a
21b
61
39c
58
61
64
62
58
64
77

22
25
25
12
23
41
47
47
43
43
46
52
39a
44
42
48
77
49
51
54
78
56
53
39c
60
59
39b
58
61
62
60a
77
61

FIG. 4
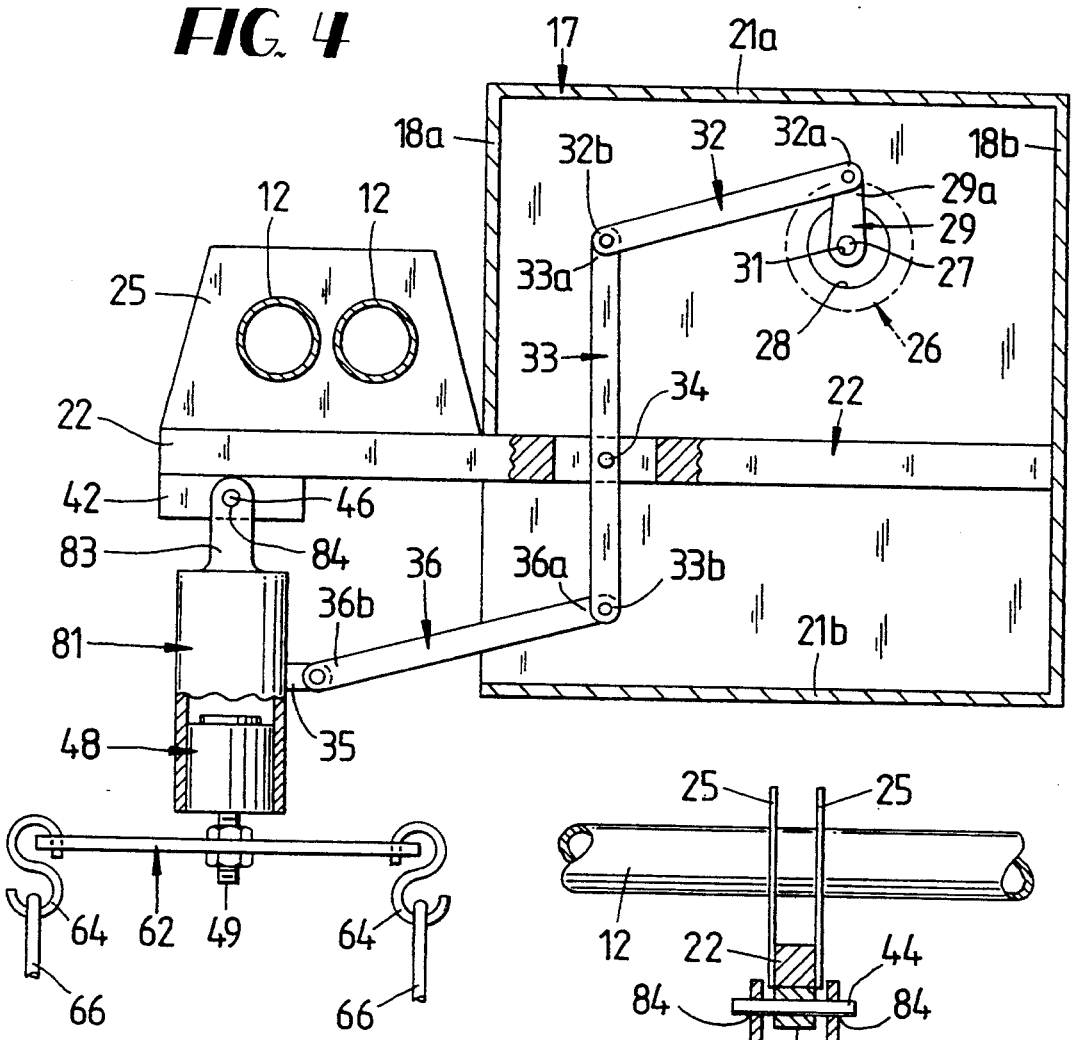
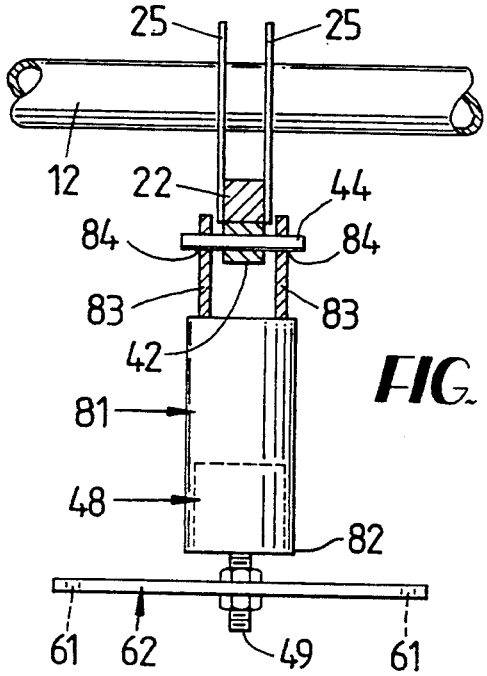
FIG. 5

REMOTELY OPERATED MOTORIZED SWING

FIELD OF THE INVENTION

The present invention relates to motorized swings for children and disabled persons. In greater particularity, the present invention relates to a swing which provides reciprocal as well as rotational movement. In even greater particularity, the present invention relates to a motorized swing that is remotely controlled either by the occupant of the swing or an outside operator.

BACKGROUND OF THE INVENTION

Driven swings for children and adults which provide oscillatory movement to the occupant of such a swing are well known. Mechanical devices which utilize stored energy in the form of a spring or similar device to provide oscillatory movement to infant swings and carriers have been developed. Electrically powered mechanisms have been used to provide reciprocating movement for infant swings as disclosed in U.S. Pat. No. 4,616,824 issued to Quinlan in 1984 and U.S. Pat. No. 4,491,317 issued to Bansal in 1985.

The swings above provide only reciprocal pendulous movement of an attached chair or carrier about a horizontal axis. While repetitive pendulous motion may be soothing, it may also be considered to be monotonous and offers little stimulation for learning or added sensory perception. Therefore, prior art swings are considered to be deficient as a rehabilitative or learning device and serve only to occupy the occupant's time without providing a challenging stimulus.

In contrast, simple observation of children at play on swings in playground environments shows that monotonous pendulous movement is often replaced by complex pendulous and rotational movement wherein the occupant exerts a twisting force such that the swing is rotated about an axis normal to the horizontal axis. No prior swings for handicapped individuals or children are known to provide this type motion; however, it is clear from simple observation of playground children that such motion greatly enhances the sensory stimuli and enjoyment of the swing occupant.

An occupant controlled rotating and reciprocating swing also provides a safe learning environment for severely impaired children to learn the skills necessary to control an electric wheelchair. In the event of serious injury or other disabling conditions, this device may provide motor control therapy needed for adults to regain work or driving skills using special controls. The above described swing provides severely disabled individuals the ability to turn and look in another direction. In general, the device can provide a greater degree of independence in addition to enhanced recreational enjoyment.

SUMMARY OF THE INVENTION

It is the object of the present invention to provide a motorized swing which both reciprocates and rotates a chair or carrier for its occupant.

Another object of the present invention is to provide a motorized swing wherein the motorized functions are remotely controlled.

Yet another object of the present invention is to provide a motorized swing which can be actuated by an occupant within said swing.

Still a further object of the present invention is to provide a motorized swing adapted with sensory switches that are activated by physically impaired occupants.

These and other objects of the present invention are accomplished through the use of a pair of direct current motors in combination with a swing and control system. The motors are driven by a direct current power supply such as a transformer connected to an AC source or rechargeable battery. A first motor provides reciprocating movement to a swing assembly. A second electrical motor pendulously movable with said swing assembly provides rotational movement to a suspended chair or carrier. A pair of electronic speed controls connect to each motor. Signals are sent from a remote control in the chair or in the hands of an operator to control the operation of the electrical motors. Sensory switches such as those sensitive to head or even eye movement are adaptable to the controls to allow a physically impaired individual to control the movements from the chair or carrier.

The remote control operation of the swing allows the occupant of the chair or carrier to control the combination of reciprocal and rotational movement. Developmental motor skills are improved as the child or handicapped individual learns to control the motion of the chair or carrier. There is a need in the recreational and rehabilitation industry for an electrically motorized swing with both rotational and reciprocal movement.

An occupant controlled rotating and reciprocating swing also provides a safe learning environment for severely impaired children to learn the skills necessary to control an electric wheelchair. In the event of serious injury or other disabling conditions, this device may provide motor control therapy needed for adults to regain work or driving skills using special controls. The above described swing provides severely disabled individuals the ability to turn and look in another direction. In general, the device can provide a greater degree of independence in addition to enhanced recreational enjoyment.

BRIEF DESCRIPTION OF THE DRAWINGS

Apparatus embodying features of my invention are depicted in the following drawings:

FIG. 4 is a side elevational view of the hanger and means for rotating; and

FIG. 5 is a side elevational view of an alternative means for rotating with a support plate mounted directly to an electric motor.

DESCRIPTION OF THE PREFERRED EMBODIMENTS

Figure 1:
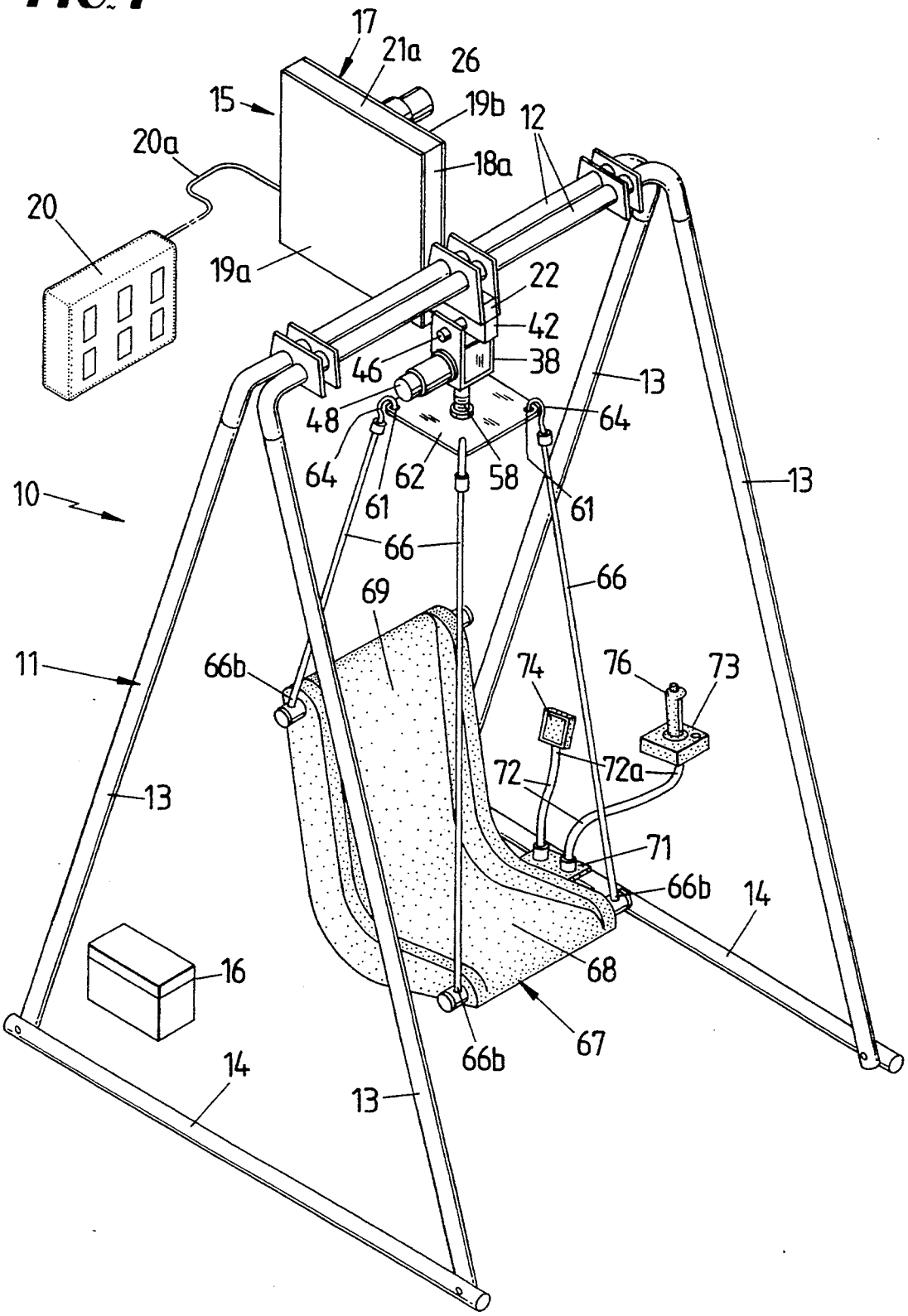
FIG. 1 is a perspective view of the motorized swing.

Referring to the drawings for a clearer understanding of the invention, FIG. 1 shows a motorized swing generally indicated by reference numeral 10. Swing 10 comprises a frame 11 which includes a pair of horizontal cross members 12 supported at each end thereof by support legs 13. The support legs 13 are braced at lower ends thereof by brace members 14. A drive unit 15 mounts transversely to said cross members 12 and is electrically connected by cable (not shown) along frame 11 to a detachable power supply unit 16 such as a battery or transformer. A switch unit 20 with a plurality of switches is electrically connected by a cable 20*a* to drive unit 15 and used to override signals sent from control unit 73 as discussed hereinafter.

Figure 2:
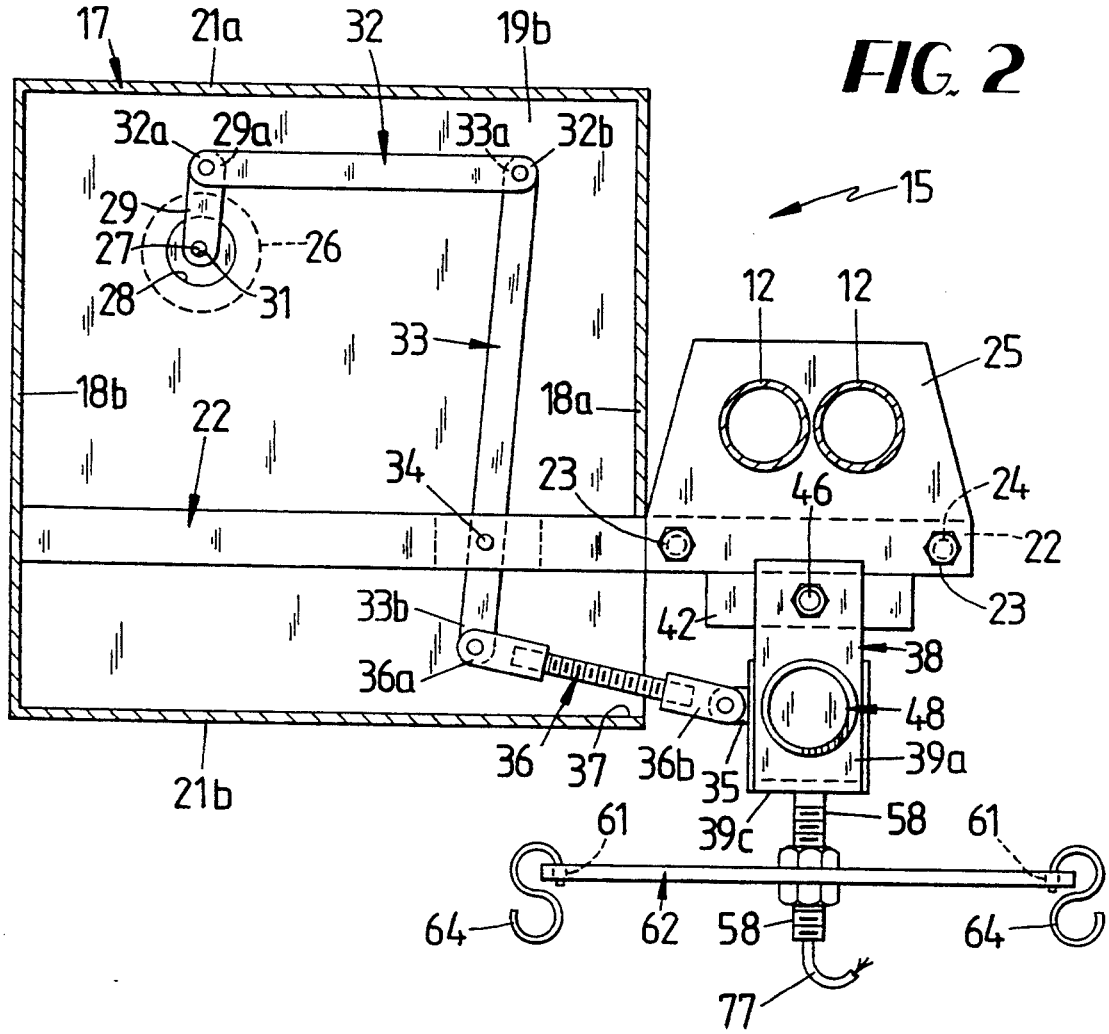
FIG. 2 is a side elevational view of the drive and control system of the present invention.

Referring now to FIG. 2, the drive unit 15 is shown in greater detail. The drive unit 15 includes a housing 17 having a front wall 18*a*, a rear wall 18*b*, a pair of side walls 19*a* and 19*b* and top and bottom walls 21*a* and 21*b* respectively. Extending horizontally through housing 17 is support member 22 which mounts beneath cross members 12, and is supported therebeneath by a pair of parallel plates 25 which are affixed to cross members 12. Fasteners 23 extend transversely through openings 24 in plate 25 to secure support member 22 in place as best seen in FIG. 2.

A first DC motor 26 is transversely mounted to side wall 19*b* of housing 17. A shaft 27 of first motor 26 extends through an opening 28 of side wall 19*b* within housing 17 as best seen in FIG. 2. An arm 29 is mounted to shaft 27 for rotational movement therewith as a bell-crank. The arm 29 is pivotally connected at an end 29*a* distal shaft 27 to an end 32*a* of first linkage member 32. The first linkage member 32 is oriented substantially horizontally within the housing 17. An end 32*b* of first linkage member 32 is pivotally connected to an end 33*a* of a second linkage member 33. This second linkage member 33 is oriented substantially vertically within housing 17 and pivotally mounted to support member 22 by a pivot pin 34 which acts as a fulcrum. The lower end 33*b* of second linkage member 33 is pivotally connected to an end 36*a* of a turnbuckle member 36 which connects to a hanger 38. The turnbuckle member end 36*b* extends from housing 17 through an opening 37 and pivotally connects to a support tab 35 laterally extending from a hanger 38.

Figure 3:
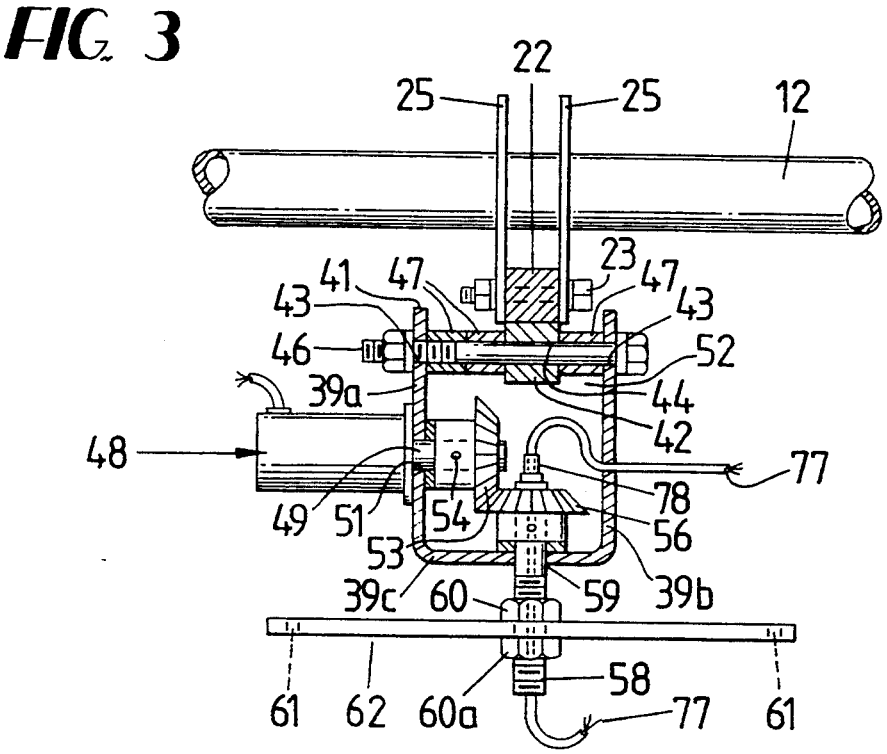
FIG. 3 is a front elevational view of the hanger and means for rotating.

In the preferred embodiment hanger 38 is a substantially U-shaped member 39 having a pair of sidewalls 39*a* and 39*b* and a bottom wall 39*c* as shown in FIG. 3. Apertures 43 extend through sidewall 39*a* and 39*b* proximal open end 41 of member 39. These apertures align with an aperture 44 which extends transversely through a support member 42. A pivot pin 46 is inserted through apertures 43 and 44 to support the U-shaped member 39 from support member 42. Spacers 47 prevent the U-shaped member 39 from moving laterally along the pivot pin 46.

A second electric motor 48 mounts transversely to sidewall 39*a* and a shaft 49 extends through an opening 51 to the interior 52 of U-shaped member 39. A first bevel gear 53 is mounted on shaft 49 of motor 48. A set screw 54 holds gear 53 in place on shaft 49 for concomitant rotation therewith. A second bevel gear 56 operatively engages first gear 53 forming a right angle. Second gear 56 has an axial opening 57 for receiving a vertical hollow shaft 58 which extends through an opening 59 in the bottom wall 39*c* of U-shaped member 39. A thrust bearing may support the gear and shaft on bottom wall 39*c*. A lower end of shaft 58 is received by an opening 61 in support plate 62 which is positioned parallel and below the bottom wall 39*c* of U-shaped member 39 as shown in FIG. 3. This lower end is threaded to receive retaining nuts 60 and 60*a* which affix support plate 62 thereto. For instance, various energy sources other than electric motors can be used.

The support plate 62 has a plurality of openings 61 defined near an outer edge thereof as best seen in FIG. 1. These openings 61 are engaged by hooks 64. Suspended from hooks 64 are a plurality of connectors 66. The connectors 66 may be cable, rope or chain and attach at the lower ends 66*b* thereof to an occupant support 67 as best seen in FIG. 1.

Occupant support 67 includes a seat 68 and a back 69 or may be some type of child carrier. Mounted to the occupant support 67 is a base 71 which supports upwardly extending flexible support members 72. The flexible support members 72 are adapted at an upper end 72*a* to support a control unit 73 and/or sensory switches 74 which are shown in FIG. 1. The control unit 73 is manipulated through manual controls 76 and may be a radio transmitter or connected to drive unit 15 by a communications wire path 77. The communications wire path 77 connects control unit 73 to drive unit 15 by passing through hollow shaft 58 of U-shaped member discussed hereinabove. An electric contact slip ring 78 known in the art of electrical contacts is used to prevent the wire path 77 from twisting as the occupant support is rotated. The sensory switch 74 includes any number of switches which are activated by head movement, eye movement or other physical movements the occupant is capable of performing. These sensory switches may be joysticks, air tube switches, contact switches, and voice activated switches.

A second embodiment for rotating occupant support 67 includes a second electric motor 48 mounted within an end 82 of a cylindrical hanger 81 as shown in FIGS. 4 and 5. The motor is mounted with a shaft 49 descending from the lower end of cylinder 82. The support plate has an axial opening for receiving shaft 49. The cylinder hanger has a pair of spaced apart tabs 83 for engaging a block 42 mounted subjacent support member 22. The pivot pin 46 is inserted through apertures 84 and block 42 to secure hanger 81 in place. The hanger 81 pivots or swings about the axis of pin 46.

In actual operation, an occupant or other operator manipulates the swing through controls 76 of control unit 73 or sensory switches 74 sending signals to the drive unit 15. The signal travels either through a radio transmitter to a receiver (not shown) or wire path 77 connected to drive unit 15. Signals activate the first electrical motor 26 which rotates shaft 27 and crank arm 29 imparting horizontal motion to the first linkage member 32 which in turn moves the second linkage member 33 in a substantially vertical plane about center pivot 34. Movement of a lower end 33*b* is transferred to the horizontal turnbuckle member 36 which connects to support tab 35 affixed to hanger 38. Reciprocal motion is imparted in hanger 38 which is in turn transferred to support plate 62 and connectors 66 to the occupant support 67.

Signals from the control unit 73 can also activate a second electric motor 48 which through a gear assembly described hereinabove rotates shaft 49 and support plate 62 in either a clockwise or counterclockwise direction. The connectors 66 and occupant support 67 are rotated in response to movement of plate 62. The second electric motor 48 has a selective power rating which prevents twisting of the connectors 66 when the occupant is in the occupant support 67. The first and second electric motors 26 and 48 may be activated simultaneously to impart reciprocal and rotational movement in response to signals from control unit 73. A set of manual switches 20 override signals from the control unit 73 for activating the first and second electric motors 26 and 48 as best seen in FIG. 1.

While I have shown my invention in several embodiments, it will be obvious to those skilled in the art that it is not so limited but is susceptible to various changes and modifications without departing from the spirit thereof. For instance, various energy sources other than electric motors can be used.

What I claim is:

1. A motorized swing comprising in combination:
(a) occupant support means pendulously suspended from a support;
(b) means for selectively rotating said occupant support means;
(c) means for inducing reciprocal movement in said occupant support means; and
(d) means for remotely controlling said means for rotating and said means for inducing reciprocal movement.

2. A swing as defined in claim 1 wherein said occupant support means is a child carrier.

3. A swing as defined in claim 1 wherein said occupant support means is a seat.

4. A motorized swing as defined in claim 1 wherein said means for inducing reciprocal movement is an electric motor operatively attached to a linkage, said linkage connected at an end thereof to said support for converting rotation motion of a shaft of said electrical motor to linear reciprocal movement of said support.

5. A motorized swing as defined in claim 1 wherein said means for inducing rotational movement comprises an electric motor affixed to said support to impart rotational movement thereto.

6. A motorized swing as defined in claim 1 wherein said means for remotely controlling includes a plurality of manually actuable switches connected by an electrical circuit to a pair of electric motors for selectively activating said motors which drive said means for rotating and said means for inducing reciprocal movement.

7. A motorized swing as defined in claim 6 wherein said means for rotating is adapted for control by sensory signals such as head movement or eye movement.

8. A motorized swing comprising in combination:
(a) a main support frame having a hanger member mounted thereto and a means for inducing reciprocal movement in said hanger member relative said main support frame, said hanger member having an occupant support suspended therefrom;
(b) a means for selectively rotating said occupant support; and
(c) a means for remotely controlling said means for rotating and said means for inducing reciprocal movement.

9. A motorized swing as defined in claim 8 wherein said means for inducing reciprocal movement is an electrical motor operatively connected to a linkage mechanism which translates rotational movement of a shaft from said motor to linear reciprocal movement of said hanger member.

10. A motorized swing as defined in claim 8 wherein said means for rotating is a second electric motor mounted on said hanger member and having a driven shaft operatively connected to or to impart driven angular motion thereto wherein said occupant support is suspended by connectors from said support plate.

11. A motorized swing as defined in claim 10 wherein said means for remotely controlling includes a plurality of manually actuable switches connected by an electrical circuit to a pair of electric motors for selectively activating said motors which drive said means for rotating and said means for inducing reciprocal movement.

12. A motorized swing as defined in claim 8 wherein said means for remotely controlling are sensory switches electrically connected to activate a pair of first and second electric motors to drive said means for rotating and said means for inducing reciprocal movement.

13. A motorized swing as defined in claim 12 wherein said sensory switches are selected from a group containing joysticks, contact switches, air tube switches or voice activated switches.

14. A motorized swing comprising in combination:
(a) a main support frame having a hanger member pivotally mounted thereto and a first electric motor connected to said hanger by a linkage means which converts rotational movement of a shaft of said first electric motor to linear movement of said hanger member;
(b) a second electric motor supported on said hanger member having a driven shaft, a support plate operatively connected to said shaft for concomitant rotation with said shaft, an occupant support suspended from said support plate by a plurality of struts; and
(c) a means for remotely activating said first and second electric motors.

15. A motorized swing as defined in claim 14 wherein said means for remotely activating is a sensory switch actuated by physical movement of an occupant of said occupant support, said sensory switch activates said first and second electric motors.

16. A motorized swing as defined in claim 15 wherein said sensory switches are selected from a group containing joysticks, contact switches, air tube switches or voice activated switches.

* * * * *